US006123596A

United States Patent [19]

Hsu

[11] Patent Number: 6,123,596

[45] Date of Patent: Sep. 26, 2000

[54] VIBRATORY SOFT YO-YO

[75] Inventor: Ming-Tay Hsu, Taipei, Taiwan

[73] Assignee: Hsiang Yuan Ltd., Taipei, Taiwan

[21] Appl. No.: 09/178,408

[22] Filed: Oct. 26, 1998

[51] Int. Cl.[7] ..... A63H 1/30

[52] U.S. Cl. ..... 446/250

[58] Field of Search ..... 446/249, 250, 446/251

[56] References Cited

U.S. PATENT DOCUMENTS 5,184,972 2/1993 Tomberlin ..... 446/250

5,254,027 10/1993 McAvoy, Jr. ..... 446/250

*Primary Examiner*—Robert A. Hafer

*Assistant Examiner*—Urszula M. Cegielnik

*Attorney, Agent, or Firm*—A & J

[57] ABSTRACT

A yo-yo include a soft body made of foam material and formed with a cavity having a passage extending through the body, and a vibrator fitted inside the cavity of soft body and including a housing, a transmission device fitted inside the housing, an eccentric disk mounted on the transmission device, and a reel mounted on the transmission device, the transmission device including a casing composed of two symmetric shells, a spiral spring arranged inside the casing and drivingly connected with the reel, a ratchet member engaged with the spiral spring, a gear train engaged with the ratchet and drivingly connected with the eccentric disk, the reel being provided with a string extending through the passage of the soft body, whereby the yo-yo can automatically vibrate and go up a string hence facilitating its operation and making it attractive and interesting.

5 Claims, 6 Drawing Sheets

VIBRATORY SOFT YO-YO

BACKGROUND OF THE INVENTION

1. Field of the Invention

This invention is related to a vibratory soft yo-yo and in particular to one which can automatically vibrate and go up a string.

2. Description of the Prior Art

The conventional yo-yo is made of two circular parts joined together that go up and down a string as the player lifts his hands up and down. However, such a yo-yo is made of hard material so that when it hit a young child, he or she will feel very painful. Hence, such a yo-yo does not meet the safety standard for young children and the player must skillfully control a string to rotate the yo-yo in order to make it go up and down thereby further making it unsuitable for young childern.

Therefore, it is an object of the present invention to provide an improved yo-yo which can obviate and mitigate the above-mentioned drawbacks.

SUMMARY OF THE INVENTION

This invention is related to an improved yo-yo.

According to the present invention, a yo-yo include a soft body made of foam material and formed with a cavity having a passage extending through the body, and a vibrator fitted inside the cavity of soft body and including a housing, a transmission device fitted inside the housing, an eccentric disk mounted on the transmission device, and a reel mounted on the transmission device, the transmission device including a casing composed of two symmetric shells, a spiral spring arranged inside the casing and drivingly connected with the reel, a ratchet member engaged with the spiral spring, a gear train engaged with the ratchet and drivingly connected with the eccentric disk, the reel being provided with a string extending through the passage of the soft body.

It is the primary object of the present invention to provide a yo-yo which can automatically vibrate and go up a string.

It is another object of the present invention to provide a yo-yo the outer surface of which is made of foam material thereby making it safe in playing.

It is still another object of the present invention to provide a yo-yo which is attractive to the young childern thus arousing curiosity and evoking interest.

It is still another object of the present invention to provide a yo-yo having an outer surface made of foam material which is resistant to collision and impact.

It is still another object of the present invention to provide a yo-yo which does not need battery power for operation.

It is still another object of the present invention to provide a yo-yo which can be used as a decoration or a toy as desired.

It is a further object of the present invention to provide a yo-yo which can simulate a beating heart, a shaking globe, or the like.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

DETAILED DESCRIPTION OF THE PREFERRED EMBODIMENT

Figure 1:
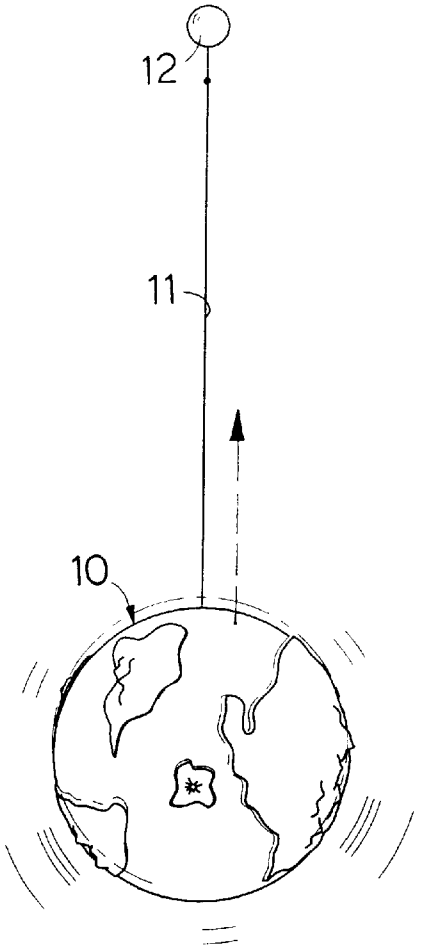
FIG. 1 is a perspective view of a first preferred embodiment of the present invention.
Figure 2:
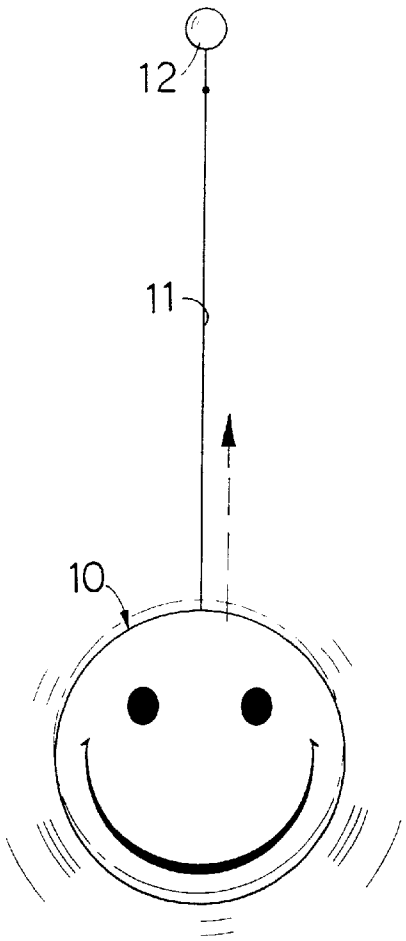
FIG. 2 is a perspective view of a second preferred embodiment of the present invention.
Figure 3:
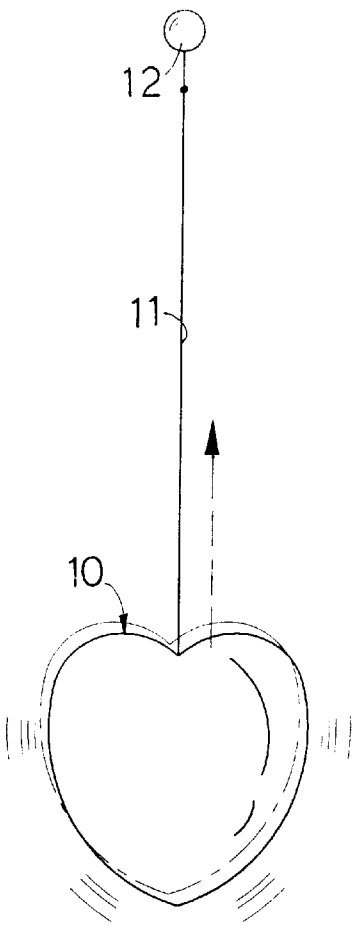
FIG. 3 is a perspective view of a third preferred embodiment of the present invention.
Figure 6:
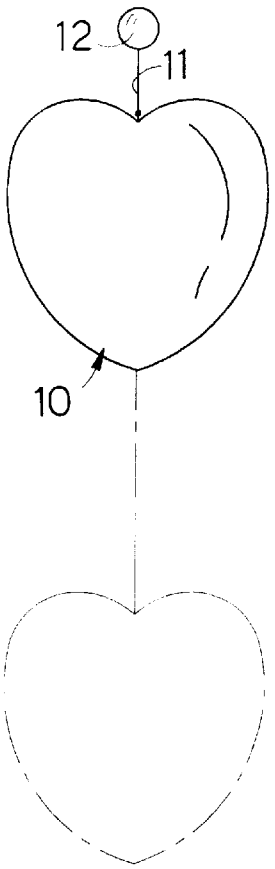
FIG. 6 is a perspective view illustrating the rise of the third preferred embodiment of the present invention.
Figure 5:
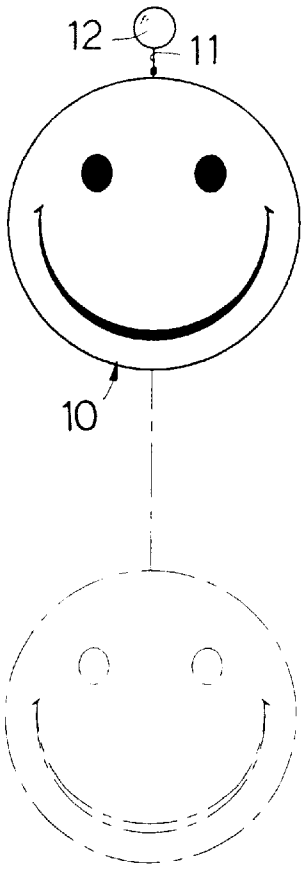
FIG. 5 is a perspective view illustrating the rise of the second preferred embodiment of the present invention.
Figure 4:
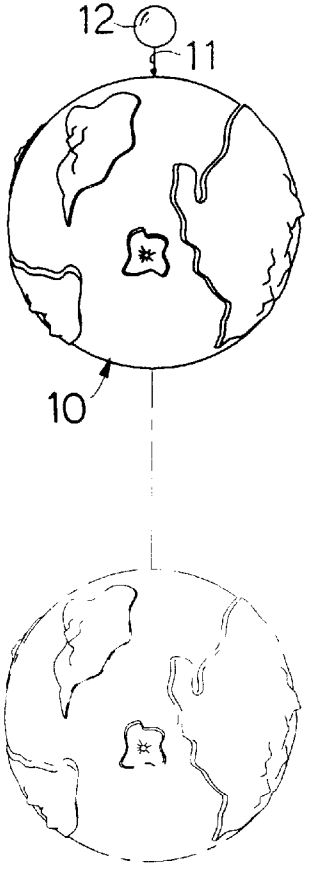
FIG. 4 is a perspective view illustrating the rise of the first preferred embodiment of the present invention.

With reference to the drawings and in particular to FIGS. 1, 2 and 3 thereof, the yo-yo according to the present invention may be shaped as a globe, a doll or a heart as desired. The upper end of the yo-yo has a string 11 provided with a bead 12 at the free end, by means of which the string 11 may be pulled out of the yo-yo to suspend the yo-yo in the air. Then, the yo-yo will automatically vibrate and go up the string 12 without any skillful operation (see FIGS. 4, 5 and 6). Hence, the yo-yo will look like a shaking globe, a skipping doll or a beating heart.

Figure 7:
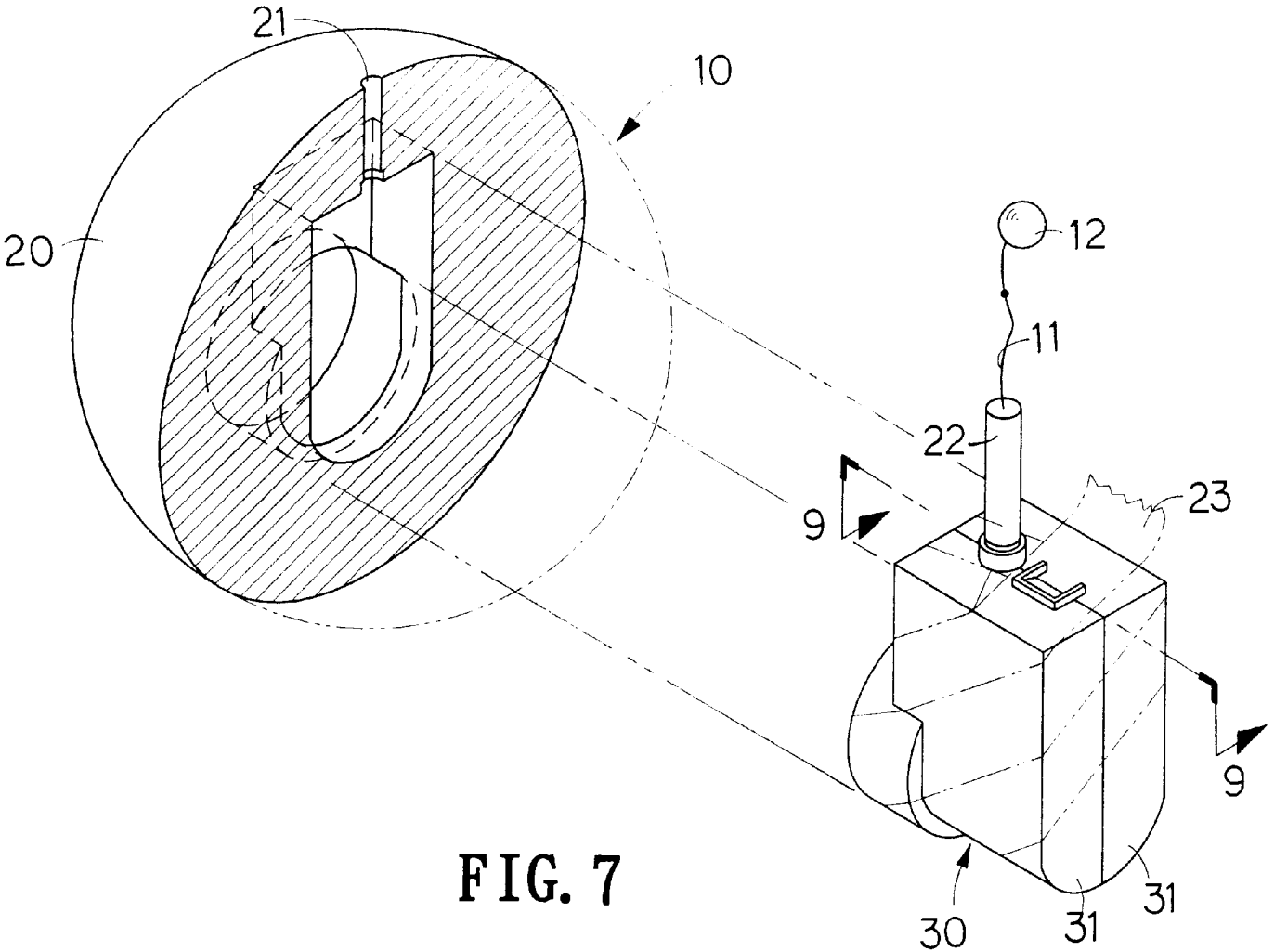
FIG. 7 is an exploded view of the present invention.

As shown in FIG. 7, the yo-yo according to the present invention generally comprises a soft body 20 made of foam material and having a cavity, and a vibrator 30 fitted inside the cavity of the soft body 20. The vibrator 30 has a string 11 extending out of a passage 21 of the soft body 20. In order to preventing the soft body 20 from being damped, the outlet of the vibrator 30 is formed with a plastic tube 22 for preventing water from entering therein. In addition, the vibrator 30 may be enclosed with a layer of water-proof tape 23 for further preventing the soft body 20 from being damped.

Figure 8:
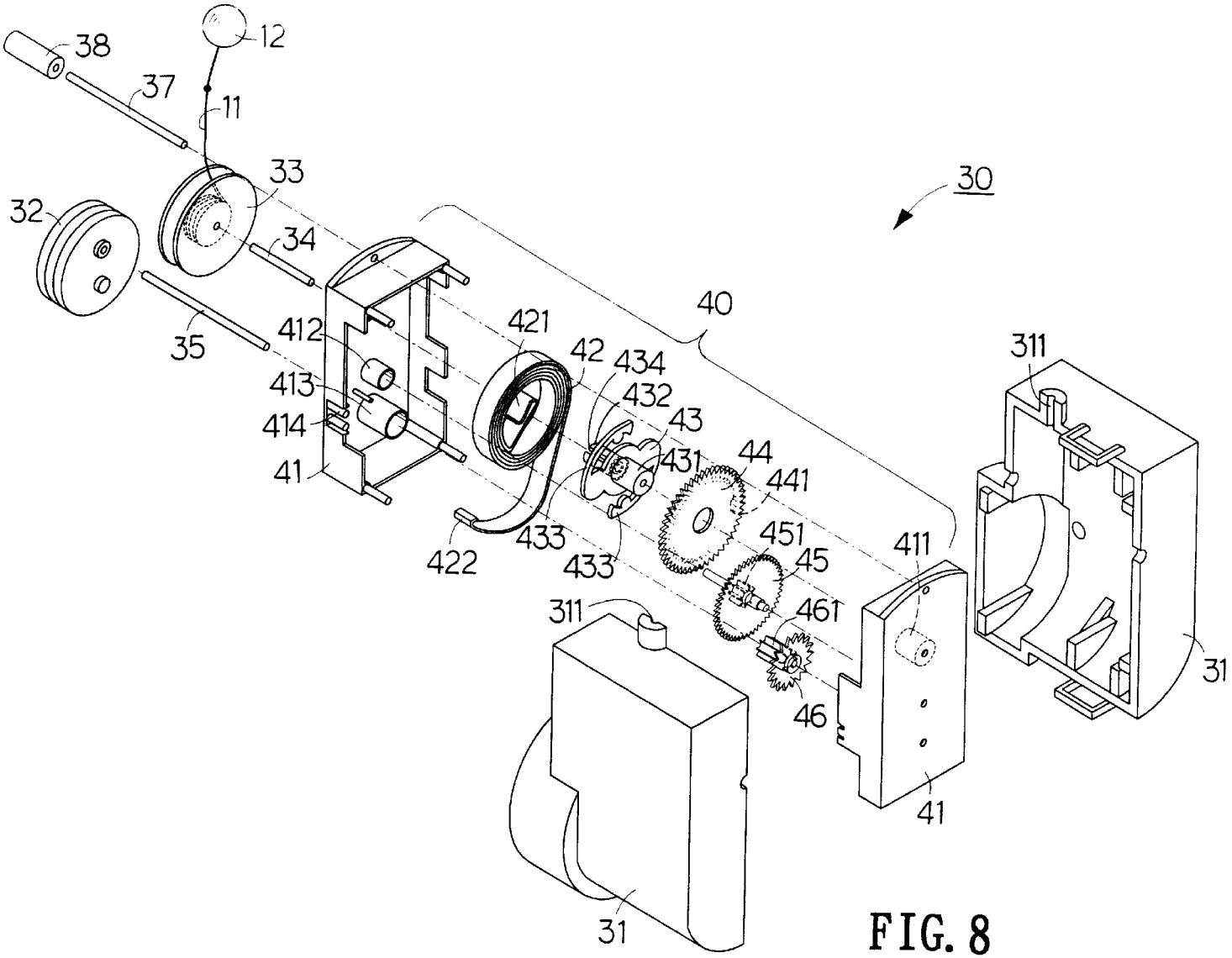
FIG. 8 is an exploded view of the vibrator.

Referring to FIG. 8, the vibrator 30 generally comprises a housing composed of two symmetric covers 31, a transmission device 40 fitted inside the housing, an eccentric disk 32 mounted on the lower portion of the transmission device 40, and a reel 33 mounted on the upper portion of the transmission device 40. The transmission device 40, the eccentric disk 32 and the reel 33 are all disposed within the housing, except that a string 11 of the reel 3 extends upwardly out of an opening 311 at the top of the housing.

The transmission device 40 generally comprises a casing composed of two symmetric shells 41, a spiral spring 42 arranged inside the casing, a ratchet member 43 engaged with the spiral spring 42, and three transmission gears 44, 45 and 46.

Figure 10:
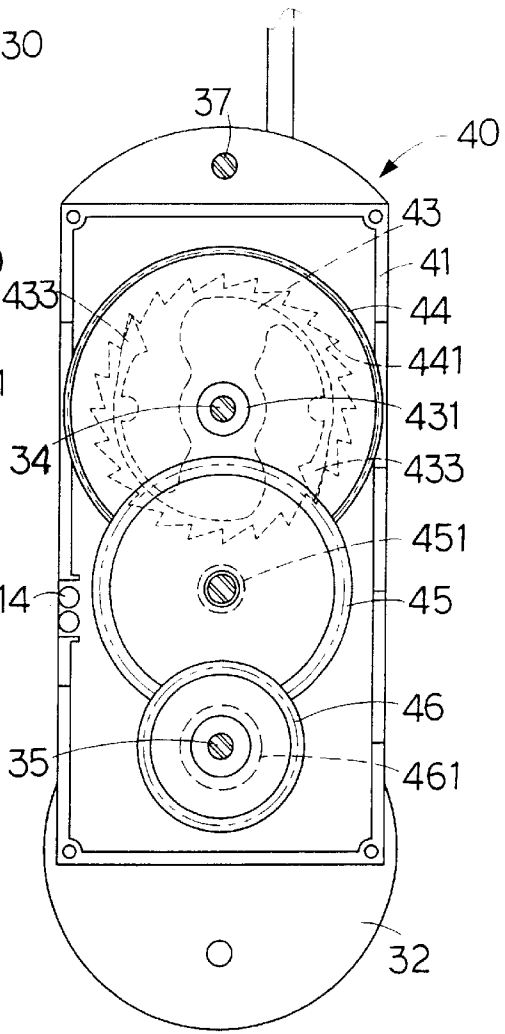
FIG. 10 is a sectional view taken along line 10—10 of FIG. 7.
Figure 9:
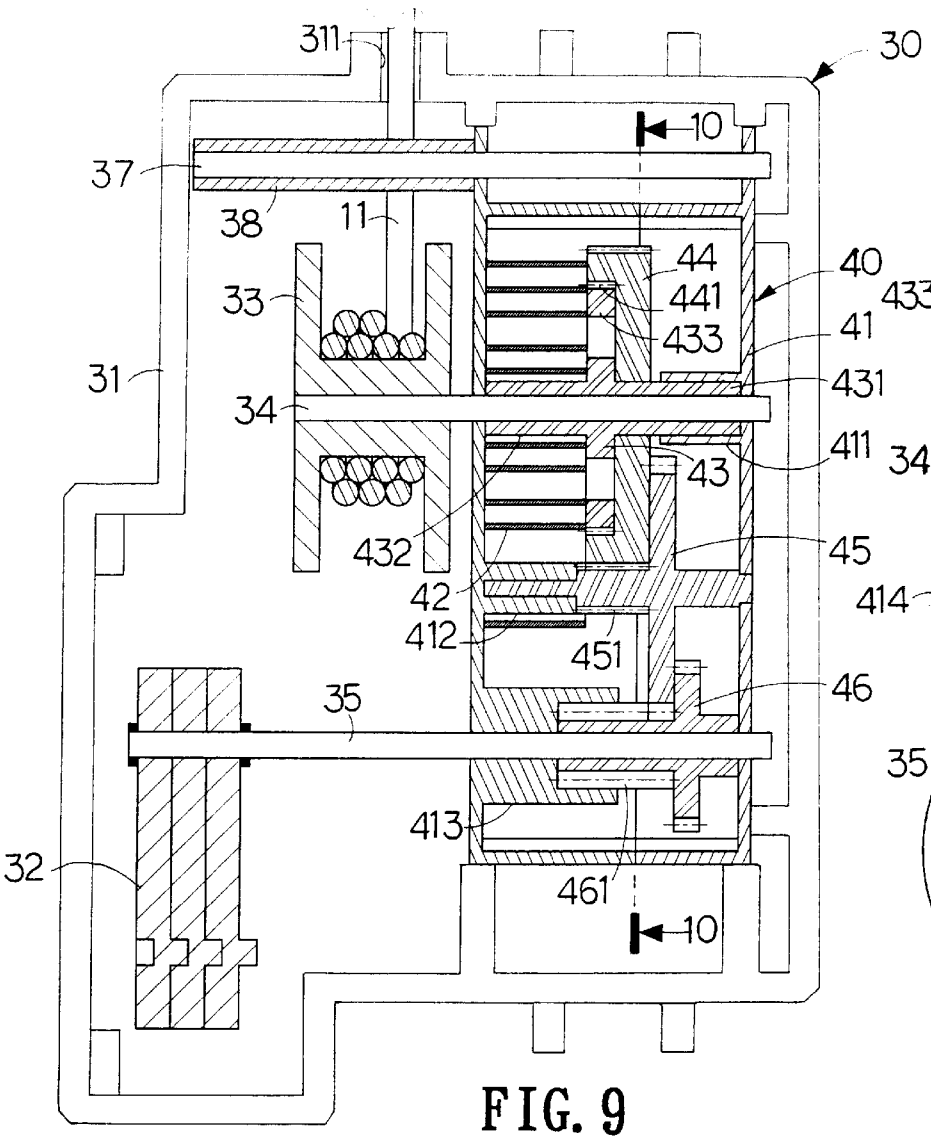
FIG. 9 is a sectional view taken along line 9—9 of FIG. 7.

Looking now at FIGS. 8, 9 and 10, an end of an axle 37 is pivotally mounted within the upper portion of the casing. The other end of the axle 37 outside the casing is enclosed with a plastic sleeve 38. One of the shells 41 has a tubular portion 411 in which is pivotally fitted an end of the ratchet member 43. An axle 34 extends through the reel 33 and the ratchet member 43. The gear 44 is fitted on the axial tubular shaft 431 of the ratchet member 43. The other one of the shells 41 has a tubular member 413 in which is pivotally fitted an axle 35. The outer end of the axle 35 is fixedly connected with the eccentric disk 32, while the inner end of the axle 35 is fixedly engaged with the gear 46. The gear 45 is provided with a pinion 451 at one side thereof. The gear 45 is meshed between the gears 44 and 46. In short, the gears 44, 45 and 46 are driving, medium and driven gears, respectively.

The ratchet member 43 is provided with two symmetric pawls 433, a first axial tubular shaft 431 at one side thereof for mounting the driving gear 44, and a second axial tubular shaft 432 having a slit 434 at another side thereof. The spiral spring 42 is mounted on the second axial tubular shaft 432, with the clip 421 at the center of the former fitted into the slit 421 of the latter. The ratchet member 43 is engaged with the driving gear 44 so that the pawls 433 are engaged with the internal teeth 441 of the driving gear 44 thereby enabling the driving gear 44 to rotate in one direction only.

The driving gear 44 is meshed with the pinion 451 at the rear side of the medium gear 45 which is in turn meshed with the pinion 461 of the driven gear 46, so that the driving gear 44 can drive the medium and driven gears 45 and 46 to rotate therewith.

Figure 11:
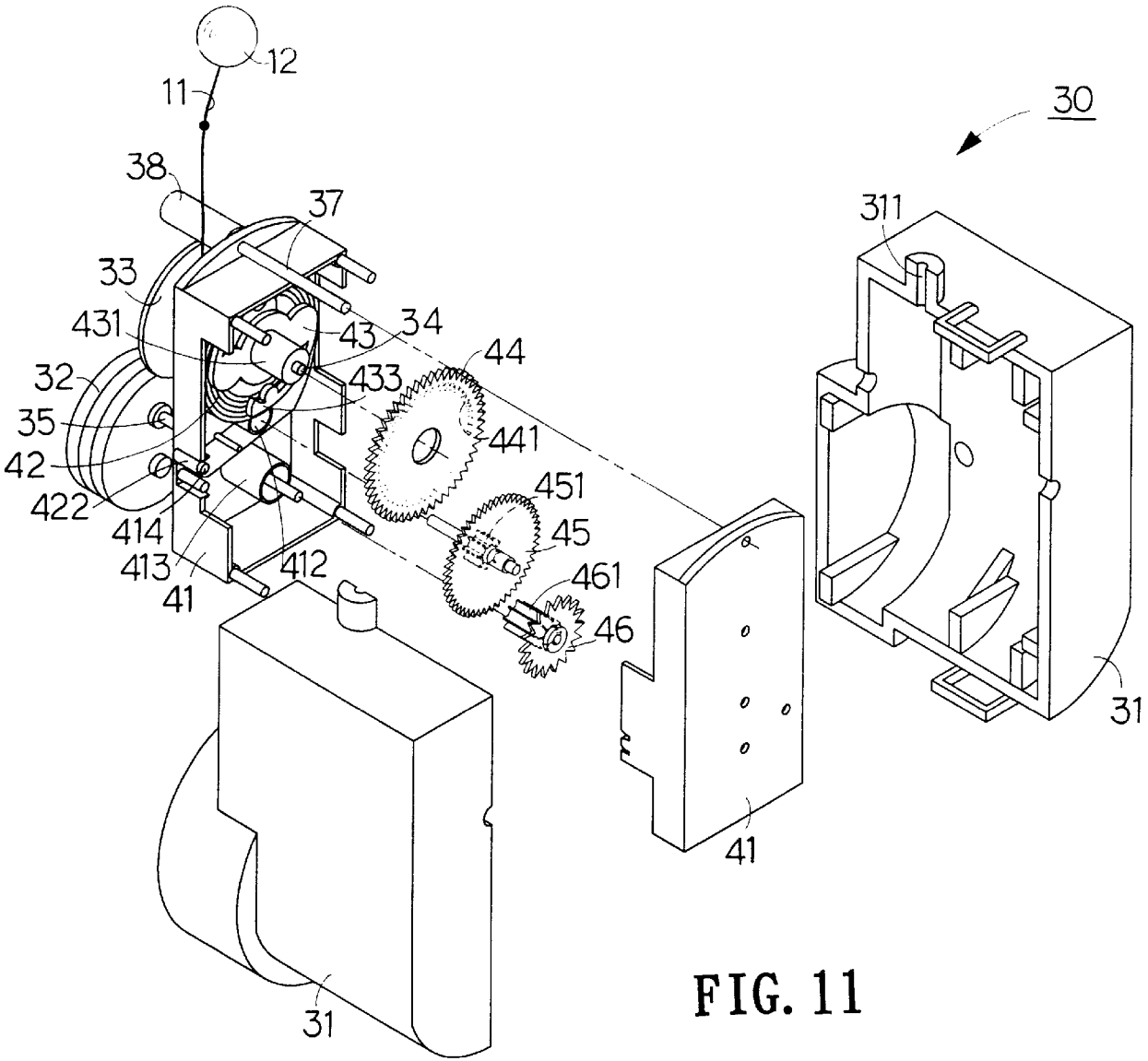
FIG. 11 is another exploded view of the vibrator.

The outer end of the spiral spring 42 has a hook 422 configured to engage with a projection 414 at one side of the cover 41 (see FIG. 11) and the inner end of the spiral spring 42 has a clip 421 fitted into the slit 434 of the second axial tubular shaft 432 of the ratchet member 43, so that the spiral spring 42 is firmly installed inside the casing of the transmission device 40. The plastic sleeve 38 is in contact with the string 11 so as to reduce the frictional force in operation.

Referring to FIG. 9, spiral spring 42 and the reel 33 are mounted on the same axle 34 so that when the string 11 is pulled to rotate the reel 33, the spiral spring 42 will be tightened. As the pawls 433 of the ratchet member 43 can prevent the driving gear 44 from rotating in reverse direction, the driving gear 44 will remain stationary when the reel 33 and the spiral spring 42 are rotated. On the contrary, when the string 11 is no longer pulled (i.e. the yo-yo is suspended in the air), the spiral spring 42 will restore to drive the ratchet member 43 to rotate the driving gear 44 thereby rotating the medium gear 45 and the driven gear 46 and therefore rotating the reel 33 and the eccentric disk 32. Therefore, the reel 33 is rotated to withdraw the string 11 so that the yo-yo automatically goes up the string 11. In the meantime, the rotation of the eccentric disk 32 causes vibration of the yo-yo.

Accordingly, the present invention is characterized as follows:

1. The yo-yo can automatically vibrate and go up a string.

2. The outer surface of the yo-yo is made of foam material thereby making it safe in playing.

3. The yo-yo is attractive to the young childern thus arousing their curiosity and interest.

4. The outer surface of the yo-yo is made of foam material which is resistant to collision and impact.

5. No battery power is required for operation.

6. The yo-yo can be used as a decoration or a toy as desired.

7. The yo-yo can simulate a beating heart, a shaking globe, or the like.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A yo-yo comprising:

a soft body made of foam material and formed with a cavity having a passage extending through said body; and a vibrator fitted inside said cavity of said soft body and including a housing, a transmission device fitted inside said housing, an eccentric disk mounted on said transmission device, and a reel mounted on said transmission device, said transmission device including a casing composed of two symmetric shells, a spiral spring arranged inside said casing and drivingly connected with said reel, a ratchet member engaged with said spiral spring, a gear train engaged with said ratchet and drivingly connected with said eccentric disk, said reel being provided with a string extending through said passage of said soft body.

2. The yo-yo as claimed in claim 1, wherein said housing of said vibrator is composed of two symmetric shells.

3. The yo-yo as claimed in claim 1, wherein said gear train includes a driving gear engaged with two pawls of said ratchet member to form a ratchet mechanism, a medium gear meshed with said driving gear, and a driven gear drivingly connected with said eccentric disk.

4. The yo-yo as claimed in claim 1, wherein said spiral spring has a clip portion at an inner end thereof configured to fit into a slit of an end of said ratchet member.

5. The yo-yo as claimed in claim 1, wherein said reel is fixedly mounted on an axle having an end enclosed with a plastic sleeve.

* * * * *